United States Patent [19]

Cheng

[11] Patent Number: 4,909,714

[45] Date of Patent: Mar. 20, 1990

[54] PRESSURE BALANCED EXTERNAL GEAR PUMP OR MOTOR OF FLOATING SHAFT TYPE

[76] Inventor: Anqiang Cheng, 13/14 Apt. No. 3, Dormutory of the Research Institute of Construction Machinery, 3rd Rd., DingziGu, Tianjin, China

[21] Appl. No.: 179,474

[22] Filed: Apr. 8, 1988

[30] Foreign Application Priority Data

Apr. 18, 1987 [CN] China ..... 87102829

[51] Int. Cl.[4] ..... F03C 2/08; F04C 2/18; F04C 15/00

[52] U.S. Cl. ..... 418/73; 418/132

[58] Field of Search ..... 418/132, 133, 205, 206, 418/71, 73

[56] References Cited

U.S. PATENT DOCUMENTS

| | | | |
|---|---|---|---|
| 2,891,483 | 6/1959 | Murray et al. | 418/132 X |
| 3,029,739 | 4/1962 | Nagely | 418/73 |
| 3,043,230 | 7/1962 | Molly | 418/73 |
| 3,961,870 | 6/1976 | Vlimmings | 418/73 |
| 3,986,800 | 10/1976 | Dworak et al. | 418/132 X |
| 4,370,110 | 1/1983 | Nagely | 418/132 |

FOREIGN PATENT DOCUMENTS

| | | | |
|---|---|---|---|
| 2623356 | 12/1977 | Fed. Rep. of Germany | 418/73 |
| 963445 | 7/1964 | United Kingdom | 418/73 |

*Primary Examiner*—John J. Vrablik

*Attorney, Agent, or Firm*—Rines & Rines

[57] ABSTRACT

An external gear pump and/or motor of floating-shaft type comprising a front cover, a back cover and a housing forming a cavity in which a pair of meshed gears are mounted, characterized in that the gear shafts are brought toward the high-pressure side by means of a sleeve which can float radially under the pressure of the hydraulic oil and meanwhile said sleeves are pushed against the ends of the gears under the pressure of the hydraulic oil so that radial floating is achieved without any additional floating means in an external gear pump and/or motor. Therefore, the size of high-pressure zone and thereby, the inherent radial force are reduced in the gear pump and/or motor according to the present invention. Furthermore, its structure is simplified and reliable and its production cost is reduced.

6 Claims, 3 Drawing Sheets

I-I

III-III

II-II

IV-IV

V-V

PRESSURE BALANCED EXTERNAL GEAR PUMP OR MOTOR OF FLOATING SHAFT TYPE

BACKGROUND OF THE INVENTION

The present invention relates to a gear pump and/or motor used in hydraulic systems and more particularly to an external gear pump and/or motor wherein the radial floating of the gear shaft is achieved by floating sleeves.

There has been a rapid development in the field of gear pumps. Various technical measures, such as employment of a larger high-pressure zone and heavy-duty Du bearings, have been taken in most pumps. It can be said that there is little potentiality in improving the performance of a gear pump of conventional structure. Therefore, manufacturers of gear pumps in many countries have been studying and developing gear pumps of new structures in recent years. Most of them are of radial floating type. Although structures of various radial floating types have been disclosed in patents in many countries, radial floating is achieved through a radial floating sealing block in all these solutions without exception. More particularly, gears, gear shafts and gear bearings in these gear pumps are relatively stationary in the radial direction. Radial floating is achieved through a floating sealing block which can move radially towards the gears, and radial sealing is achieved through two sections of circumferential wall on the floating sealing block coincided with the driving gear and the driven gear respectively. A gear pump of such a radial floating type is apparently complicated in structure and has a relatively larger radial dimension.

SUMMARY OF THE INVENTION

Accordingly, it is a general object of the present invention to overcome the above-mentioned disadvantages in the prior art.

More particularly, it is an object of the present invention to provide an improved external gear pump or motor of radial floating type without the floating sealing block, which exists without any exception in the prior art.

Still more particularly, it is an object of the present invention to provide such an improved external gear pump or motor wherein the structure is simplified and the radial floating can be achieved so as to enhance its performance.

In order to get a clear understanding of the present invention, we should first know the functions of radial floating in a gear pump or motor. It is not the only function of radial floating to provide radial sealing means under high pressure. The main function of radial floating is that the sealing is achieved in a high-pressure zone, not in a low-pressure zone as in a gear pump or motor of non- radial-floating type, so that high-pressure zone is much reduced and the radial force existing inherently in a gear pump or motor is reduced by a big margin, thereby to enhance the performance of a gear pump or motor.

The essence or gist of the present invention lies in that radial floating is achieved by means of radial floating sleeves in which gears, gear shafts and bearings are mounted. In a gear pump or motor according to the present invention, there is no floating sealing block. Compared with the conventional gear pump or motor wherein radial floating is achieved by means of a floating block, the gear pump or motor according to the present invention has the same advantages such as sealing achieved in high-pressure zone, reduction in the size of high-pressure zone and in the radial force, and it achieves the main function of radial floating. Moreover, it is simplified in structure, reduced in size and easy to manufacture.

BRIEF DESCRIPTION OF THE DRAWINGS

Further novel features and other objects of this invention will become apparent from the following detailed description, discussion and appended claims taken in conjunction with the accompanying drawings showing preferred embodiments, in which:

DESCRIPTION OF THE PREFERRED EMBODIMENTS

Figure 1:
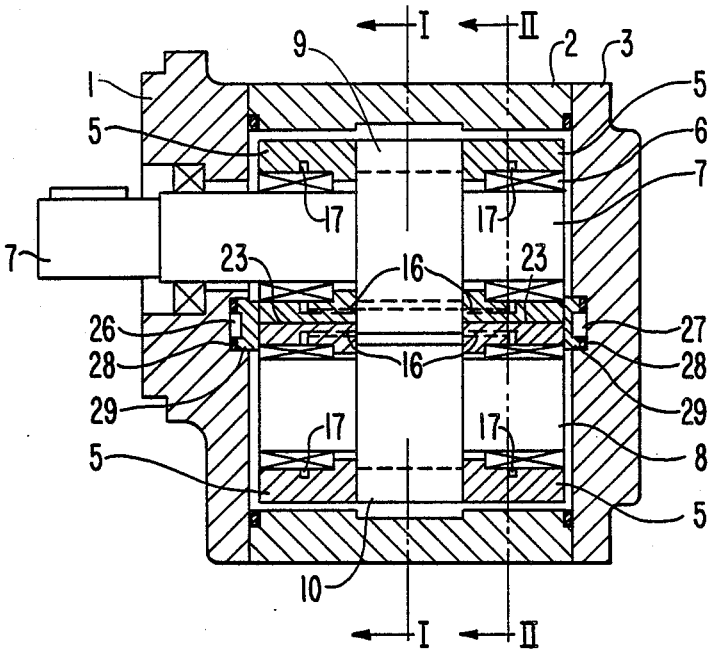
FIG. 1 is an axial section through an external gear pump of floating shaft type according to one embodiment of the present invention.
Figure 2:
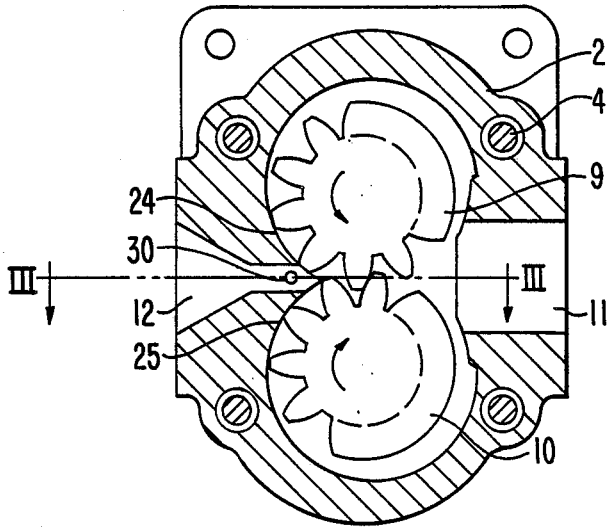
FIG. 2 is a cross section taken along line II—II of FIG. 1.
Figure 3:
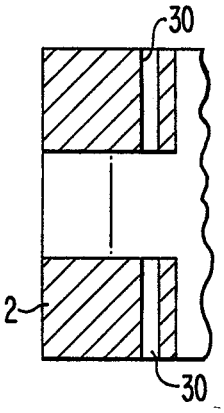
FIG. 3 is a fragmentary sectioned detail view taken along line III—III of FIG. 2.

FIGS. 1–4 show the structure of a preferred embodiment of the ear pump according to the present invention. As shown in FIG. 1, a casing consists of three parts: a front cover 1, a housing 2 and a back cover 3. These three parts are fastened together by means of four bolts 4 or similar connecting devices as shown in FIG. 2. The housing 2 is formed with an interior cavity constituted by two axially parallel overlapping bores 13, so that the cavity has a cross-sectional configuration resembling a numeral 8. Four sleeves 5 are arranged in the bores 13. Each of the sleeves 5 is provided with a bearing 6 which supports a driving gear shaft 7 or a driven gear shaft 8 respectively. A driving gear 9 is made integral with the driving gear shaft 7 and a driven gear 10 is made integral with the driven gear shaft 8. The gear 9 is meshed with the gear 10. When the gear pump is running, the driving gear shaft 7 is rotated by an outside power supply (not shown) so that the gear 9 and the gear 10 rotate respectively in the directions of the arrows as shown in FIG. 2. Hydraulic oil is then sucked in through an inlet 11 on the housing 2. Said hydraulic oil is then brought into the high-pressure side on the left through the space between adjacent teeth, becomes high-pressure oil owing to the squeeze by the teeth and then flows out through an outlet 12 on the housing 2.

What is different from the conventional gear pump without radial floating, that is, the characteristic of the gear pump according to the present invention, lies in that the outer diameter of the sleeves 5 is 0.02 m–0.05 m (m denotes module of the gear that is, the ratio of the tooth pitch of the gear to) less than the diameter the bores 13 in the housing 2 so that the sleeves 5 can not only float radially but also support the bearings 6, the gear shafts 7, 8 and thereby gears 9, 10 to float radially.

Figure 4:
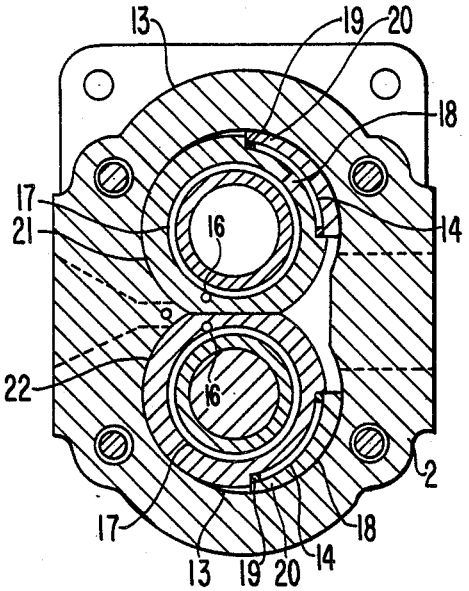
FIG. 4 is a cross section taken along line IV—IV of FIG. 1.
Figure 5:
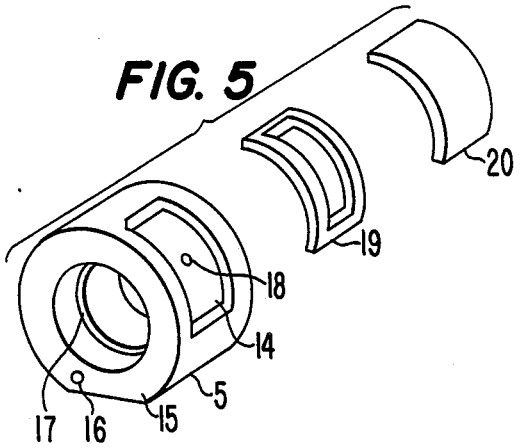
FIG. 5 is a perspective of the floating sleeve used in a gear pump according to the present invention.

The way of radial floating is now described in detail by reference to FIGS. 4 and 5. A slot 14 is provided on the outer cylindrical surface of the sleeves 5 near the low-pressure side. The slot 14 is rectangular as seen in a radial direction. The slot 14 can also be called a radial back-pressure slot 14. A front surface 15 (adjacent to the end of the gear) of each of the sleeves 5 is provided with an orifice 16 in a high pressure zone on the left side of said cavity (see FIG. 4). The orifice 16 communicates with an annular groove 17 formed in the inner cylindrical surface of each of the sleeves 5. An orifice 18 communicates the annular groove 17 with the radial back-pressure slot 14. A rectangular sealing ring 19 and nylon lid 20 are used for sealing between the radial back-pressure slot 14 and the housing 2. During the operation of the gear pump, high-pressure oil flows into the radial back-pressure slot 14 through the orifice 16, the annular groove 17 and the orifice 18 to push the sleeves 5 against two sections of inner circumferential wall 21 and 22 on the high-pressure side or the left side of said cavity and to make the sleeves 5 contact each other at the combination plane 23. The driving gear shaft 7 is made integral with the gear 9, the driven gear shaft 8 is made integral with the gear 10, the gear shafts 7 and 8 are supported by the bearings 6 respectively and the bearings 6 are tightly fitted in the sleeves 5. When the sleeves 5 are pushed against the two sections of the inner circumferential wall 21 and 22 under the pressure of the hydraulic oil, the gears 9 and 10 are brought to the high-pressure side by the sleeves 5 and the addenda of the gears 9 and 10 scrape closely along two sections of the inner circumferential walls 24 and 25 coincident with the outside diameter of the gear 9 or 10 respectively so that radial sealing in the high-pressure zone of the gear pump is maintained.

Figure 6:
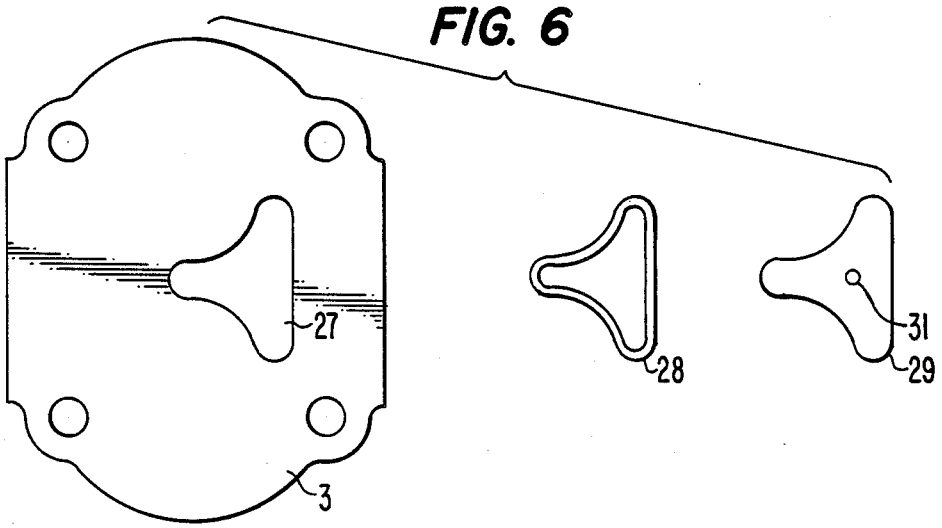
FIG. 6 is a detached view of the back cover, seal ring and nylon lid used in a gear pump according to the present invention.

As shown in FIGS. 1 and 6, a special-shaped slot 27 (or an axial back-pressure slot 27) is provided in the back cover 3 and a special-shaped slot 26 (or an axial back-pressure slot 27) of the same shape and size with the slot 27 is provided at a corresponding position in the front cover 1. Each of these special-shaped slots 26 and 27 is respectively sealed with a similar special-shaped sealing ring 28 and a similar special-shaped lid 29. When the gear pump is running, high-pressure oil flows respectively into the axial back-pressure slot 26 in the front cover 1 and the axial back-pressure slot 27 in the back cover 3 through an orifice 30 in the housing 2 communicating with the outlet 12, the two ends of the housing 2 and the orifice 31 in the special-shaped lids 29 so as to produce back-pressure which pushes the sleeves 5. Thus the four sleeves 5 in the front and back ends of the gear pump are pushed against the ends of the driving gear 9 and of, the driven gear 10 and the axial sealing is therefore maintained.

It can be seen as above explained that through the means of the hydraulic floating sleeves 5, gear shafts 7 and 8 and thereby the gears 9 and 10 are moved towards the high-pressure zone and at the same time the hydraulic floating sleeves 5 are moved towards the ends of the gears 9 and 10.

The above is described according to the mode of operation when the present invention is used as a gear pump. If high-pressure oil enters from the outlet 12, a torque can be obtained on the gear shaft 7, and the gear pump turns into a gear motor. If the sleeves 5 are replaced by double acting sleeves and some improvements are made in the oil passages, the gear pump will turn into a gear motor which can rotate in both directions. Such a gear motor is now described by reference to FIGS. 7, 8, 9, 10 and 11.

Figure 7:
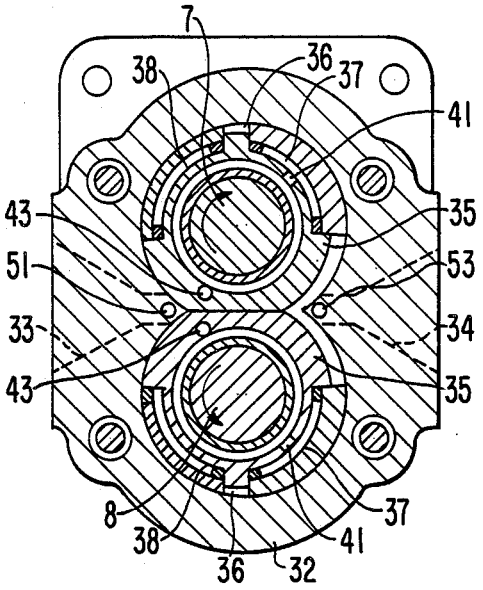
FIG. 7 is a cross section of a gear motor according to the present invention taken through the floating sleeve.
Figure 8:
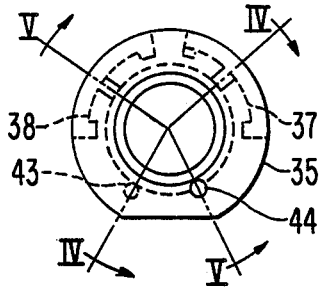
FIG. 8 is back view of the floating sleeve used in the gear motor shown in FIG. 7.
Figure 9:
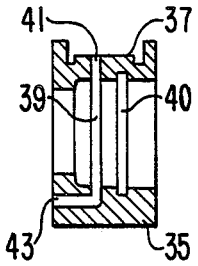
FIG. 9 is a section taken along line IX—IX of FIG. 8.
Figure 10:
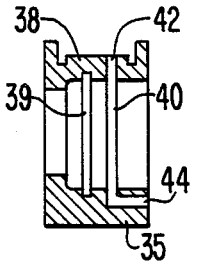
FIG. 10 is a section taken along line X—X of FIG. 8.
Figure 11:
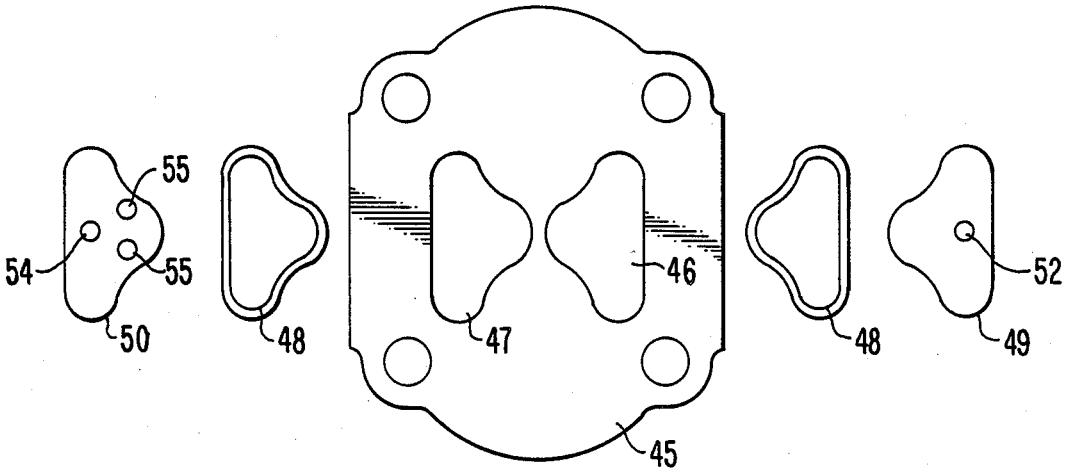
FIG. 11 is a detached view of the back cover, seal rings and nylon lids used in the gear motor according to the present invention.

In order to avoid unnecessary repetition, only what is different from the gear pump will b described. Different from the housing 2 shown in FIG. 2, the housing 32 of the gear motor according to the present invention is provided with two oil passages 33 and 34, which are of same shape and size and symmetric with respect to the longitudinal axis of the gear motor as shown in FIG. 7. Four double acting sleeves 35, instead of sleeves 5, are mounted in the cavity constituted by the two bores 36 within the housing 32. The outer diameter of the double acting sleeves 35 is also 0.02 m–0.05 m (m again denotes the before-described module of the gears) less than the diameter of the bores 36. As shown in FIGS. 8, 9 and 10, each of the double acting sleeves 35 is provided with two symmetric slots 37 and 38 or radial back-pressure slots 37 and 38). In order to introduce high-pressure oil respectively into the radial back-pressure slots 37 and 38, each of the double acting sleeves 35 is provided with two parallel annular grooves 39 and 40, as shown in FIGS. 8, 9 and 10. The annular groove 39 communicates with the radial back-pressure slot 37 through an orifice 41 and leads to the front end of the double acting sleeve 35 through an orifice 43. The annular groove 40 communicates with the radial back-pressure slot 38 through an orifice 42 and leads to the back end of the double acting sleeve 35 through an orifice 44. FIG. 11 is a detached view of the back cover 45, seal rings and nylon lids as seen from the front side. As shown in FIG. 11, the back cover 45 is provided with two special-shaped slots 46 and 47 (or axial back-pressure slots 46 and 47) which are symmetric with respect to the longitudinal axis of the gear motor and are sealed respectively by a special- shaped seal ring 48 and a special-shaped lid 49, 50 (the front cover of the gear motor has axial back-pressure slots 46, 47).

FIG. 7 illustrates the operation of the gear motor which rotates in counter-clockwise direction. The oil passage 33 on the left acts now as an inlet from which high-pressure oil enters and rotates the gear shafts 7, 8 in the direction of the arrows shown in FIG. 7 so that a torque is obtained on the gear shaft 7, while the oil passage 34 on the right acts as an outlet through which the oil is discharged. Under these circumstances, the oil passage 33 on the left is in the high-pressure zone while the oil passage 34 on the right is in the low-pressure zone. When the high-pressure oil is rotating the gear shafts 7, 8, the high-pressure oil also flows into the radial back-pressure slot 37 and pushes the double acting sleeves 35 towards the left so that radial sealing is achieved as described hereinbefore. The housing 32 is also provided with an orifice 51 communicating with the high-pressure zone. The high-pressure oil flows into the axial back-pressure slot 46 through the orifice 51 and an orifice 52 formed in the special-shaped lid 49 to push the double acting sleeves 35 against the ends of the gears so that axial sealing is achieved.

When the gear motor rotates in clockwise direction, oil passage 34 on the right acts as an inlet through which high-pressure oil enters and it is in the high-pressure zone. The oil passage 33 on the left acts as an outlet through which the oil is discharged and it is in the low-pressure zone. The high-pressure oil entering from oil passage 34 rotates the gear shafts 7, 8 in the directions opposite to the arrows shown in FIG. 7 to produce a clock-wise torque on the gear shaft 7. At the same time, the high-pressure oil flows into the axial back-pressure slot 47 through an orifice 53 communicating with the high-pressure zone formed in the housing 32 and an orifice 54 in the special-shaped lid 50 to push the double acting sleeves 35 against the ends of the gears so as to maintain axial sealing. Also, the high-pressure oil continues to flow from the axial back-pressure slot 47 to the radial back-pressure slot 38 through an orifice 55 in the special-shaped lid 50, an orifice 44 in the double acting sleeves 35, the annular groove 40 and an orifice 42 to push the double acting sleeves 35 towards the high-pressure zone on the right (contrary to the double acting sleeves 35 at a position on the left shown in FIG. 7, the double acting sleeves 35 are now at a position on the right) so as to achieve radial sealing.

In this way, the gear motor of floating-shaft type according to the present invention can rotate in both directions.

As important hydraulic components, gear pumps and/or motors have been developing rapidly. Therefore, if a new type of gear pump and/or motor is expected to compete in the market place, it must be both advanced in performance and cheap in price. The present invention breaks through the principle on the structure of conventional gear pumps and/or motors that the gear shafts and, the bearings of a gear pump and/or motor are not allowed to move radially. Radial floating in the gear pump and/or motor according to the present invention has been achieved in a manner of "sleeves→bearings→gear shafts". This floating type is unique in principle and most simple in structure (without an additional radial floating means). Moreover, the gear pump and/or motors according to the present invention have a very satisfactory performance because radial floating is achieved and thereby inherent radial force is reduced. For example, the highest pressure of the gear pump according to the present invention can reach 321 $Kgf/cm^2$.

What is claimed as new and desired to be protected by Letters Patent is set forth in the appended claims.

1. A gear pump of floating-shaft type comprising a front cover; a back cover; a housing with an inlet and an outlet therein, an interior cavity of said housing being constituted by two axially parallel overlapping bores; a pair of gears mounted in said cavity and having meshing teeth, said gears being made integral with their gear shafts which are supported in bearings; a high-pressure zone and a low-pressure zone divided by said gears in said cavity, characterized in that each of said bearings is tightly fitted in a sleeve, the diameter of which is less than that of said bores so as to provide a clearance therebetween; each of said sleeves being provided with a radial back-pressure slot in the outer cylindrical surface thereof and with a passage through which high-pressure oil is introduced from said high-pressure zone so that, under the pressure of said high-pressure oil, said sleeves bring said gear shafts and thereby said gears to push against two sections of inner circumferential walls of said housing, with said sleeves being pushed against the ends of said gears in the axial direction by means of two axial back-pressure slots respectively formed in said front cover and back cover.

2. A gear pump according to claim 1, wherein the diameter of said sleeves is 0.02 m–0.05 m (m denotes the module of the gears) less than that of said bores.

3. A gear pump according to claim 1, wherein said passage of high-pressure oil includes an annular groove provided in the inner cylindrical surface of said sleeves.

4. A gear motor of floating-shaft type comprising a front cover; a back cover; a housing with an inlet and an outlet, an interior cavity of said housing being constituted by two axially parallel overlapping bores; a pair of gears mounted in said cavity and having meshing teeth, said gears being made integral with their gear shafts which are supported in bearings, a high-pressure zone and a low-pressure zone divided by said gears in said cavity, characterized in that each of said bearings is tightly fitted in a double acting sleeve, the diameter of which is less than that of said bores so as to provide a clearance therebetween; each of said double acting sleeves being symmetrically provided with two radial back-pressure slots into which means is provided for introducing high-pressure oil depending on a selected rotational direction respectively through a passage communicating with a high-pressure zone so that, under the pressure of said high-pressure oil, said double acting sleeves bring said gear shafts and thereby said gears towards the high-pressure zone on either side and axial back-pressure slots respectively formed in front cover or in the back cover enabling said double acting sleeves to be pushed against the ends of said gear whenever the gear motor is running in either direction of rotation.

5. A gear motor according to claim 4, wherein the diameter of said double acting sleeves is 0.02 m–0.05 m less than that of said bores.

6. A gear motor according to claim 4, wherein said passage of high-pressure oil includes two parallel annular grooves provided in the inner cylindrical surface of said double acting sleeves respectively for the operation in either direction of rotation.

* * * * *